United States Patent [19]

Korpela

[11] Patent Number: 4,854,052

[45] Date of Patent: Aug. 8, 1989

[54] FLOATER RADIATION DRYER

[75] Inventor: Matti Korpela, Turku, Finland

[73] Assignee: Valmet Oy, Finland

[21] Appl. No.: 113,181

[22] PCT Filed: Mar. 13, 1987

[86] PCT No.: PCT/FI87/00034

§ 371 Date: Oct. 16, 1987

§ 102(e) Date: Oct. 16, 1987

[87] PCT Pub. No.: WO87/05644

PCT Pub. Date: Sep. 24, 1987

[30] Foreign Application Priority Data

Mar. 14, 1986 [FI] Finland ..... 861086

[51] Int. Cl.[4] ..... F26B 23/04; D21F 5/16; D21F 5/18

[52] U.S. Cl. ..... 34/68; 34/41; 34/156; 162/375

[58] Field of Search ..... 34/4, 41, 68, 156; 162/207, 192, 375, 290

[56] References Cited

U.S. PATENT DOCUMENTS

| | | | |
|---|---|---|---|
| 3,499,232 | 3/1970 | Zimmermann | 34/68 |
| 4,290,210 | 9/1981 | Johansson | 34/156 |
| 4,494,316 | 1/1985 | Stephansen et al. | 34/68 |
| 4,513,516 | 4/1985 | Bjornberg | 34/41 |
| 4,594,795 | 6/1986 | Stephansen et al. | 34/41 |

FOREIGN PATENT DOCUMENTS

| | | |
|---|---|---|
| 2351280 | 1/1979 | Fed. Rep. of Germany . |
| 626711 | 9/1978 | France . |
| 352121 | 12/1972 | Sweden . |
| 566099 | 7/1977 | U.S.S.R. . |

*Primary Examiner*—Karen Hastings
*Attorney, Agent, or Firm*—Steinberg & Raskin

[57] ABSTRACT

A floater dryer for drying a web-shaped (W), moving material, in particular a paper or cardboard web. The dryer comprises a plurality of radiation/air blowing units (10) which are provided on one side of the web (W) or on both sides (10A,10B). The units (10) have been shaped to be blow boxes having on their side facing the web (W) a contact-free carrier surface (21R,27) and into conjunction with which is blow, through a nozzle aperture (**20*a*,20*b*) opening on the leading and/or trailing edge of the carrier surface, an air jet (Ful), or air jets (Fua,Fub). The jets will have a substantially large component parallel to said carrier surface. In conjunction with the radiation/air blowing units (10) are provided radiation elements (30) from which into the treatment interval ($P_1$, $P_2$, P-) is directed radiation ($S_O$) through a window (27). The window at the same time serves as carrier surface for the air support of the web (W). The air flows ($F_3$,$F_4$) from the blow box are also conducted to serve as cooling air for the radiation elements (30) and for components in conjunction therewith. On the side opposite to the carrier surface (27,21R) of the radiation/air blowing units (10) may be provided a mirror arrangement (32,33**) which returns radiation that has passed through the web (W), back to the web (W).

22 Claims, 3 Drawing Sheets

FLOATER RADIATION DRYER

BACKGROUND OF THE INVENTION

The object of the present invention is a floater dryer for drying a web-like material, particularly a paper or cardboard web, said dryer comprising a plurality of radiation/air blowing units which are provided on one or both sides of the web, and said units being designed to be blow boxes of which the side facing the web is a contact-free carrier surface and in conjunction with which is blown an air jet, or air jets, through a nozzle aperture opening onto the leading or trailing edge of said carrier surface. The jets will have a component of substantial magnitude parallel to the plane of said carrier surface.

In addition, the invention concerns a procedure for enhancing the drying of web-like moving material wherein combined radiation and air drying is applied, this being implemented with combined radiation/air blowing units, through their nozzle slit or slits an air blow jet or air blow jets being directed into a treatment interval and the web that is being dried being supported with their aid without contact.

In the prior art, so-called floater dryers are known in which a paper web, a cardboard web or equivalent is dried without contact. Floater dryers are for instance used in paper coating apparatus after a roll or brush applicator to support without contact and to dry the web which is wet owing to the coating substance. Various drying and supporting air nozzles and arrays thereof are applied in floater dryers. Said blow nozzles may be classified by two groups: over-pressure nozzles and subatmospheric pressure nozzles, both kinds being applicable in the floater dryer and procedure of the invention.

The commonest floater dryers of prior art in present use are exclusively based on air blowings. Partly for this reason, the floater dryers become rather bulky because the distance over which the floater dryer is active has to be rather long so that high enough drying effect might be achieved. In part, these drawbacks are due to the fact that in air drying the penetration depth of drying is rather minimal.

In prior art various types of dryers are known which are based on the effect of radiation, above all of infrared radiation. Using infrared radiation affords the advantage that the radiation has a fairly high penetration depth, which increases with decreasing wavelength. Application of infrared dryers in drying a paper web has been hampered, among other things, by fire hazard because infrared radiators attain rather high temperatures, e.g. 2000° C. if it is desired to achieve a drying radiation with sufficiently short wavelength.

Regarding the state of art, reference is furthermore made to DE OS No. 2351280, which discloses a certain kind of combination of floater dryer and infrared dryer operating with over-pressure nozzles. In the patent application just cited is disclosed a one-sided floater dryer comprising consecutive nozzle boxes spaced in relation to each other. These boxes have nozzle slits on their marginal parts, through said slits air jets being directed against the web thereabove, specifically at right angles, these jets when they meet the web being deflected outward at the nozzle box. Between said nozzles infrared radiators have been disposed which fill the interval between nozzles. As far as the present applicant is aware, said dryer has not come into any widespread use, at least, which is believed to be due to the circumstance that it has not been understood, neither structurally nor in the energy economy respect, in said nozzle design to combine air and radiation drying in an advantageous way. The structure is moreover one-sided, and it requires rather much space in the direction of travel of the web if one wishes to attain high enough drying power, for instance in paper after-treatment installations.

A drawback with major effect encumbering said DE-OS, and other infra dryers of prior art, is that in them the space between the infrared dryer and the web being dried is not ventilated, with the consequence that the humid air in said space absorbs radiation and this lowers the efficiency. In infra-dryers of prior art, moisture transfers from the surface of the web that is being dried to the air virtually only by effect of free convection, and this lowers the evaporating power.

SUMMARY OF THE INVENTION

The main objective of the present invention is to avoid the drawbacks outlined in the foregoing. The aim of the invention is to provide a novel floater dryer combining air and radiation drying which is more advantageous than any earlier design in the structure of the dryer installation as well as its energy economy, and a procedure for enhancing the operation of a floater dryer.

The object of the invention is also to provide a combination of air and radiation dryer which presents a lower risk of fire compared with floater air dryers of prior art.

An additional object of the invention is to provide a combination of air and radiation dryer in which the contact-free floater dryer can be made shorter and more compact than before. Hereby machine hall space will be saved, and better energy economy will be promoted.

In order to achieve the aims presented, and others which will become apparent later on, the floater dryer of the invention is mainly characterized in that in conjunction with said radiation/air blowing units have been disposed radiation elements from which radiation is directed into the treatment interval through a window, said window art the same time having been arranged, on its part, to serve as carrier surface in the air support of the web, and that the air flows of said blow box have in part at least been conducted to serve as cooling air for the radiation elements and for components adjacent to them.

The procedure of the invention for enhancing the operation of a floater dryer is mainly characterized in that the drying radiation is directed on the web in said air supporting and air drying interval, that the treatment interval is ventilated with said air blowing, or blowings, and the air boundary layer in conjunction with the web is broken up in order to enhance the drying effect of radiation, and that the treatment air is used to ventilate and cool the components and spaces in conjunction with the radiation elements.

By combining a floater dryer and a radiation dryer in the way taught by the invention the following advantages, among others, are gained over radiation dryers of prior art. Evaporation from the web is made more efficient even if the power output of the radiation source were reduced to some extent. The degree of efficiency of the drying process can be increased because the important interval between the infra-radiator and the web is ventilated. The dryer can be built to be more enclosed than before and larger drying units can be used than at present. Moreover, the dryer can be thermally lagged with greater efficiency than before. In the invention the supporting and drying air blowing is used towards lowering the temperature of the radiator structure, e.g. of the quartz glass or equivalent, whereby the fire hazard will be less.

Compared with floater dryers of prior art exclusively based on drying and supporting blow jets the following advantages, among others, are gained. Higher evaporation capacity than before can be implemented, and control of the drying profile in the transversal direction is feasible more advantageously than before. Control of drying power becomes possible, if desired separately for each unit and/or radiation element, whereby good profile management is achieved.

Since in the invention the drying energy is advantageously supplied predominantly in the form of infra-radiation, the air apparatus and duct system, which used to require much space, can be substantially reduced and thereby smaller apparatus dimensions become possible even though the apparatus unit size can be increased from what it was before.

It is possible in the dryer of the invention to use for nozzle structures either over-pressure nozzles or subatmospheric pressure nozzles, which are substantially similar to the well-known float or foil nozzles. In the invention, the protective glass of the infra-lamps advantageously serves as carrier surface.

In the invention, the supporting and drying air is advantageously used to cool the holders of the infra-lamps and other components in the vicinity, and at the same time the air itself is warmed up and the dry air which has been warmed up in this manner is conducted with the aid of slit nozzles against the web in such manner that the blowing has a component of substantial magnitude parallelling the web.

BRIEF DESCRIPTION OF THE DRAWINGS

In the following, the invention is described in detail, referring to certain embodiment examples of the invention, presented in the figures of the drawing attached, to the details of which the invention is in no way narrowly confined.

DESCRIPTION OF THE PREFERRED EMBODIMENTS

Figure 1:
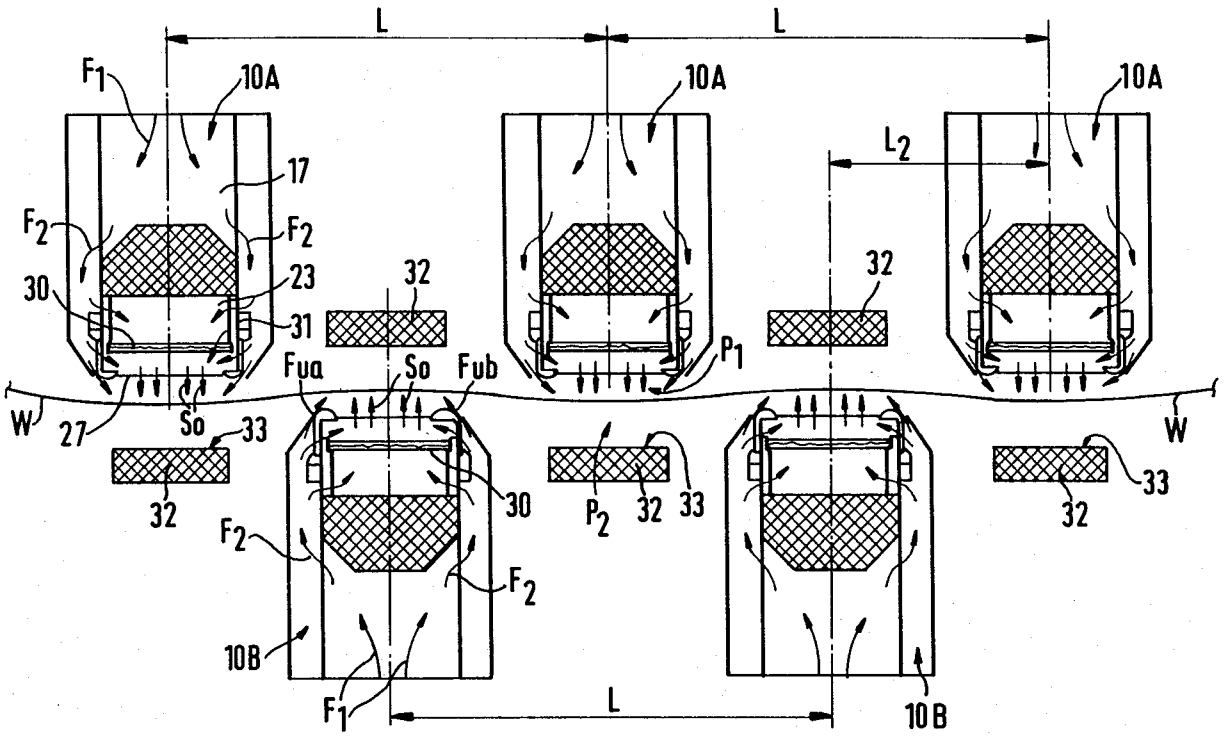
FIG. 1 presents in schematic elevational view a combined radiation and air dryer according to the invention.

As shown in FIG. 1, the web W, for instance a paper or cardboard web coated on both sides in a roll or doctor coater, is being dried and at the same time treated without contact with a radiation/air dryer according to the invention. In the dryer, the path of the web W is gently wavy. The dryer comprises a plurality of elongated radiation/ blowing units 10A above the web, extending in the cross-web direction, and similar units 10B below the web. The topside and underside units 10 have been disposed in intercalation, halfway in the intervals L between the opposed units 10. The units 10 operate with over-pressure, producing an over-pressure region $P_1$ in the space between their carrier surface 27 and the web W. The upper and lower units 10 may be identical.

In the following is described the design and operation of the unit 10, referring to FIG. 2.

The unit 10 comprises a nozzle box of symmetrical design with reference to its contral plane K—K. The nozzle box comprises an end wall 11 having an aperture **11*c* for incoming air $F_1$. The box has vertical outer walls 12*a* and 12*b* and vertical walls 13*a* and 13*b*. The walls 12*a*, 13*a*, respectively 12*b*, 13*b*, define between themselves side spaces 15*a* and 15*b*, which continue on the side facing the web W, forming nozzle apertures 20*a*, 20*b*, which are confined on the outside by the chamfered marginal parts 16*a*, 16*b* of the outer walls. The nozzle apertures 20*a*, 20*b* are confined on the inside by L-shaped corner parts 21*a*, 21*b*, of which the outer surface 21R is rounded with radius R, starting at the nozzle apertures 20*a*, 20*b***.

Between the walls **13*a* and 13*b* is provided a mirror wall 19 reflecting the radiation $S_0$, with a thermal lagging 18 therabove. Below the wall 19, wall portions 24*a* and 24*b* resistant to high temperature have been provide, on their outer sides infrared radiator elements (lamps) 30 being fixed in holders 29*a* and 29*b*, there being a plurality of such radiators in succession in the transversal direction of the web W. The radiation space 31 of the radiator elements 30 towards the web W is confined, on the side facing the web, by a quartz glass window 27, which has been mounted in grooves 28*a* and 28*b* of the L-parts 21*a* and 21*b*. Electricity is carried to the infra-radiators 30 by means of leads 26*a* and 26*b*, which have been fixed on connection strips 25*a* and 25*b* on the outer sides of the walls 24*a* and 24*b*. A mirror 33 on the opposite side of the web W, in conjunction with which a thermal lagging 32 has been provided, cooperates with the unit 10**.

In the following the operation of the floater dryer and the steps of the procedure of the invention shall be described with reference to FIGS. 1 and 2. The drying-/supporting air is introduced through the apertures **11*c* of the units 10 in the space 17, whence it is distributed through apertures 14*a* and 14*b* as a flow $F_2$ into the side spaces 15*a* and 15*b*, whence cooling air flows $F_3$ for the infra-radiators 30 are conducted into the space 23 through apertures 22*a* and 22*b* in the walls 24*a* and 24*b*. Moreover, flows $F_4$ are conducted from the spaces 15*a* and 15*b* through slits, apertures or equivalent at the top end of the walls 21*a* and 21*b* into the radiations space 31, to serve as cooling air for the radiator elements 30 and for components adjacent to them. Said cooling air is discharged e.g. into an air recirculation or through the grooves 28*a* and 28*b*** of the radiation window, or through other aperatures, into the space $P_1$.

In the same manner described above, the drying and supporting air can be efficiently utilized also towards cooling the infrared radiators and components in their vicinity, and the air which has thus been warmed up can be efficiently utilized in web drying and supporting.

Through the nozzle slits **20*a* and 20*b*, air jets Fua and Fub are directed against each other into the space $P_1$, where a drying effect is exerted on the web W, in addition, by the radiation $S_0$ from the infrared radiators 30, this radiation entering through the window 27. The window 27 contributes to forming the carrier surface of the air nozzles 20*a*, 20*b***.

The air jets Fua and Fub are not directed at right angles against the web W; they are specifically directed under suitable angle a against each other. The magnitude of the angle a is between 40 and 70 degrees as a rule. The curved outer surface 21R of the L-shaped walls 21*a* and 21*b* serve as curved Coanda surfaces of the nozzles 20*a* and 20*b*, which "draw" the flows Fua and Fub towards each other and onto the side of the drying interval $P_1$.

The flows Fua and Fub create in the drying interval $P_1$ an over-pressure region which keeps the web W at an appropriate distance from the carrier surface of the air nozzles. At the same time, according to the procedure of the invention, the flows Fua and Fub efficiently break up the boundary air layer in conjunction with the web W and promote the effect of the radiation drying $S_0$ on the web W. Furthermore, the flows Fua and Fub ventilate the drying intervals $P_1$ and thereby reduce the harmful absorption of infra-radiation $S_0$ in the drying interval. Part of the radiation $S_0$ passes through the web W, and this radiation is returned to constitute the radiation $S_2$ drying the web W in the drying interval $P_2$.

Thus, one achieves with the blow effects Fua and Fub of the invention, in addition to normal air support and air drying effect, enhancement of the radiation drying effect of the infra-radiation elements 30, which have even structurally been advantageously integrated in the units 10.

The width s of the nozzle apertures 20*a*, 20*b* is usually on the order of s=1–2 mm. The gap $e_1$ of drying interval $P_1$ is usually on the order of $e_1$=5–40 mm, and the gap $e_2$ of the drying space $P_2$ between the mirror 33 and the web, usually on the order $e_2$=5–40 mm.

It is essential in the invention that the blow effects Fua and Fub are not directed at right angles against the web but instead under a given angle a towards the carrier surface 27, whereby said blow effects produce the above-described radiation drying-boosting effect, in addition to the effects known in the art. It is advantageous if the blow nozzles 20*a* and 20 *b* are so oriented that the blow jets do have a certain component perpendicular against the web W, because due to this component, combined with the other factors, the boundary air layer present in conjunction with the web can be successfully broken up.

Figure 2:
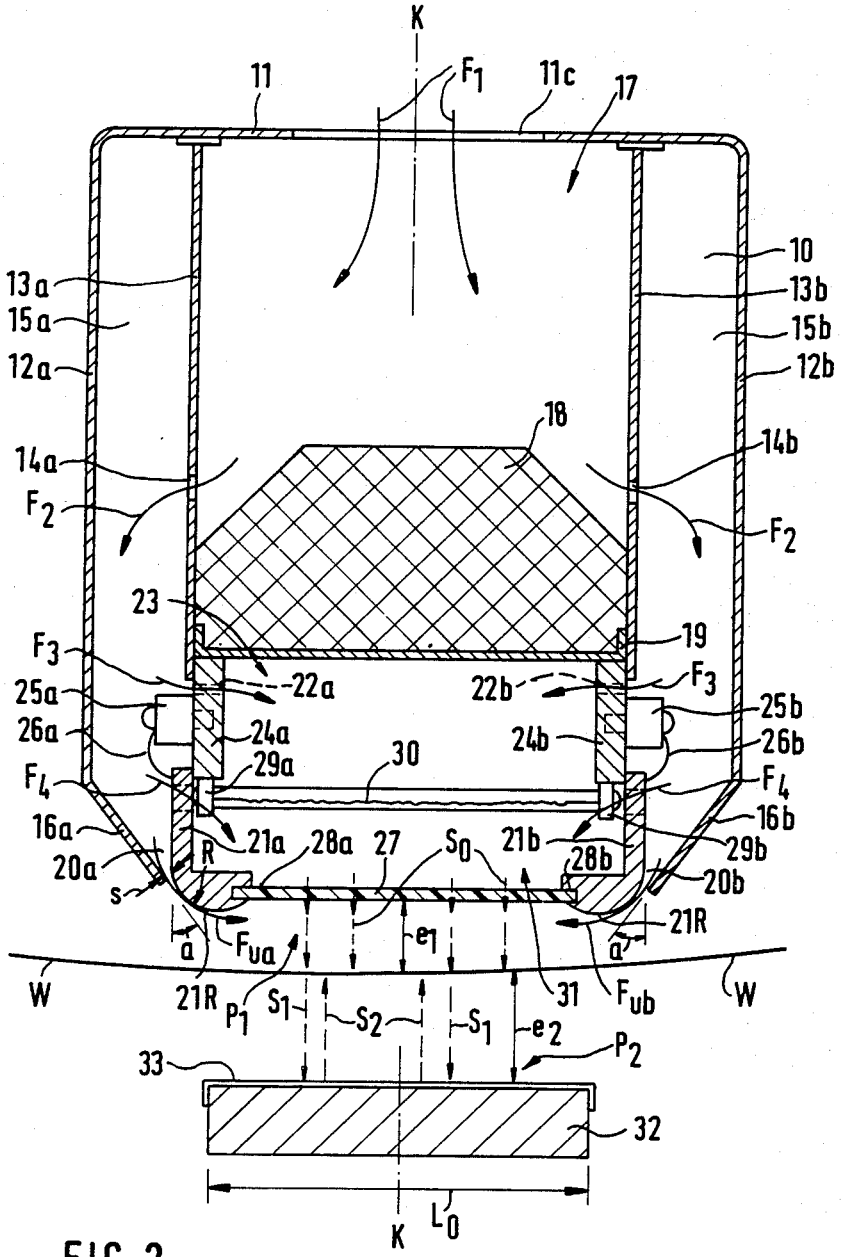
FIG. 2 presents, on a larger scale, in vertical section the design of the combined radiation and air dryer unit applied in the floater dryer of FIG. 1.

In FIG. 2, the length of the mirror 33 has been denoted with $L_0$. This length $L_0$ is substantially equal to the length in the direction of the web of the treatment interval $P_1$, $P_2$. The ratio of said length $L_0$ to the distance L between units 10 is $L_0/L$=0.3–0.7, preferably about 0.5.

Figure 3:
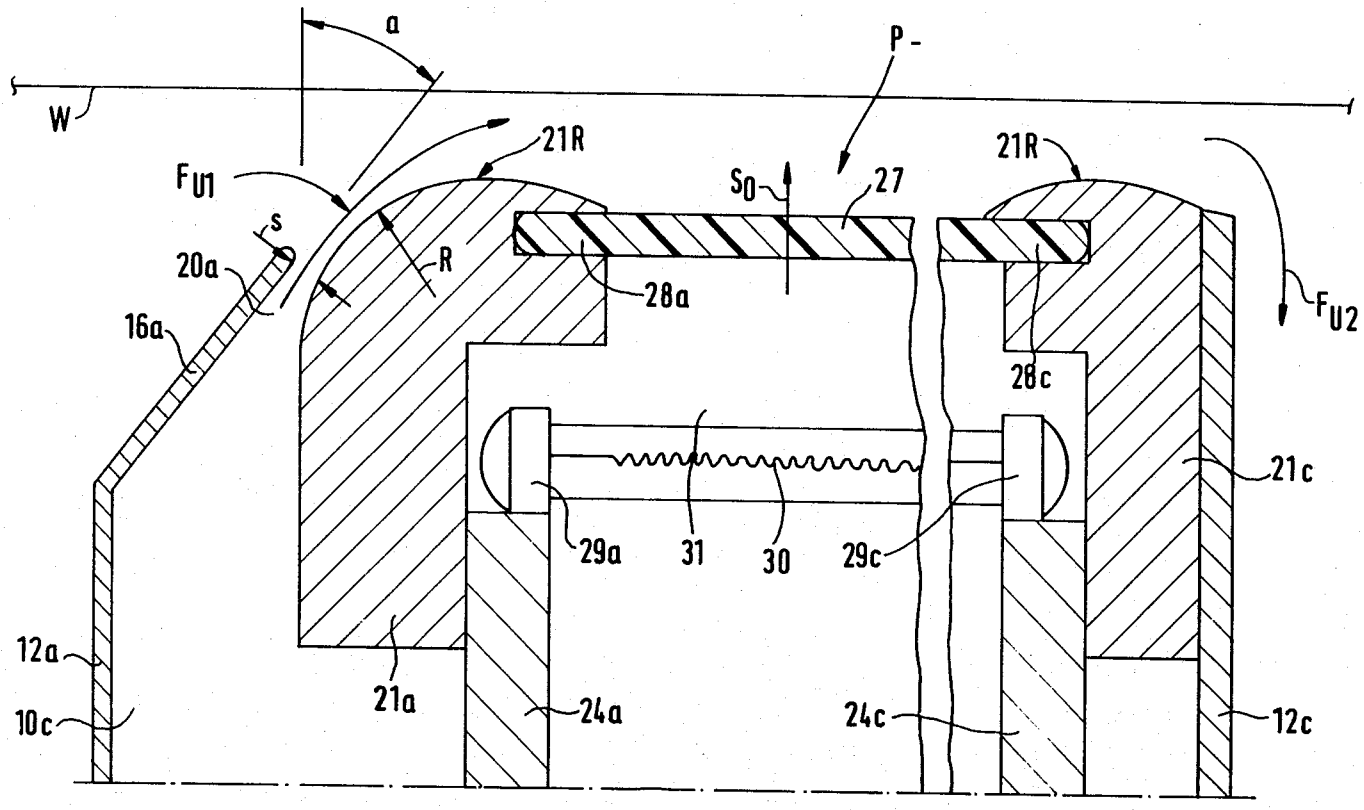
FIG. 3 presents the subatmospheric pressure nozzle of the invention and its geometry.

FIG. 3 presents a schematic cross section of the subatmospheric pressure nozzle of the invention, which has only on one margin of its units 10*c* a nozzle aperture 20*a*, from which a blow jet Fu1 is blown out under the angle a with reference to the web W. This blowing produces in the air/radiation treatment interval P— a subatmospheric pressure region, which in a manner known in itself in the art supports and stabilizes the web W. In the radiation interval P— the radiation drying effect $S_0$ is exerted with infrared elements 30. The infrared window 27 has been fixed between L-shaped holders 21*a* and 21*c*, in grooves 28*a* and 28*c* in the latter. The infra-elements 30 are mounted between holders 29*a* and 29*c*, these holders being affixed to the walls 24*a* and 24*c*. The unit 10*c* has another end wall 12*c* without nozzle aperture in its conjunction, and the flow Fu2 blown into the treatment interval P— discharges as flow Fu2 at the wall 12*c*. In other parts the design is like that of FIG. 2.

As can be seen in FIGS. 2 and 3, the nozzle aperture(s) is/are positioned to direct substantially large component(s) of the gas jets substantially parallel to the carrier surface and oriented to direct the gas jet(s) at an angle a with respect to a plane substantially perpendicular to a plane substantially parallel to the material.

The floater dryers of the invention are either one-sided or two-sided but most appropriately, and to the greatest efficiency, they are two-sided and it is to advantage to use in them the mirror elements 33 described in connection with FIG. 2, by which the infra-radiation that has passes through the web W is returned to dry the web W.

It is advantageous in the floater dryer of the invention if the major part of the drying energy is directed against the web specifically in the form of radiation $S_0$, whereby the air apparatus can be made small in size and the efficiency can be improved. For example, 70 to 90% of the total drying energy are radiation energy and the remainder are energy introduced together with the drying and supporting air.

When, as taught by the invention, a plurality of radiation elements 30 lying in parallel in the cross-web direction are used, the moisture profile of the web W in the transversal direction can be advantageously controlled by making adjustable the electric power which is fed each radiation element 30 or to different groups of such elements. It becomes possible, in this way, to control the moisture profile even very accurately, and steeply; this is further assisted by the fact that the greater part of the drying energy is directed against the web W specifically in the form of radiant energy. Moreover, the overall level of drying can be controlled by controlling the power level of the elements 30. These controls are faster and more accurate, and implementable more simply, compared with the alternative that said controls would be effected in the way of prior art, i.e., by controlling the air quantities or the state of the drying air. The latter modes of control are particularly awkward in profile control, and they lead to complex apparatus designs.

In the present invention also that important advantage can be realized that the quantity and velocity of the blow air may be selected specifically in view of web support and stabilizing, so that a maximally trouble-free and stable passage through the dryer is achieved; this is clear since the drying effect proper can be adjusted and controlled by controlling or setting the power of the radiation $S_0$.

Various details are allowed to vary within the inventive idea hereby described and to deviate from that which has been presented in the foregoing by way of example only.

I claim:

1. Apparatus for drying a moving, web-shaped material (W), comprising at least one radiation/gas blow unit (10) shaped in the form of a blow box and positionable to have a contact-free carrier surface (27) on a side thereof facing the moving material (W), means defining a pair of nozzle apertures (20*a*, 20*b*) positioned to open at opposite edges (21*a*, 21*b*) of said carrier surface (27) from one another, positioned to direct components of gas jets (Fua, Fub) exiting therethrough substantially parallel to said carrier surface (27), and oriented to direct the gas jets (Fua, Fub) exiting therethrough against one another and at an angle (a) with respect to a plane substantially perpendicular to a plane substantially parallel to the material (W), and generate an over-pressure region ($P_1$) between said carrier surface (27) and the moving material (W), an element (30) for generating radiation which is positioned in said unit (10), a window (27) positioned to form at least part of said carrier surface (27) and through which radiation ($S_0$) released by said element (30) passes and is directed at the moving material (W), means for directing a gas flow ($F_1$) through said unit (10) in a direction to cool said radiation element (30), and two holders (21*a*, 21*b*) in which said window (27) is mounted, each said holder (21*a*, 21*b*) comprising a curved surface (21R) facing the moving material (W) and positioned with respect to a respective nozzle aperture (20*a*, 20*b*) to constitute a Coanda surface and deflect the gas jets (Fua, Fub) exiting from said respective nozzle aperture (20*a*, 20*b*) toward said over-pressure region ($P_1$).

2. The apparatus of claim 1, additionally comprising a plurality of said units (10).

3. The apparatus of claim 2, wherein said units (10A) are positioned on the same side of the moving material (W).

4. The apparatus of claim 2, wherein said units (10A, 10B) are positioned on opposite sides of the moving material (W).

5. The apparatus of claim 4, comprising a plurality of units (10A, 10B) arranged on each opposite side of the material (W) at given distances with respect to one another.

6. The apparatus of claim 5, wherein said units (10A, 10B) on one side of the material (W) are positioned in staggered ralationship with respect to said units (10A, 10B) on the opposite side of the material (W).

7. The apparatus of claim 6, additionally comprising a mirror (32) positioned on an opposite side of the material (W) from each side unit (10).

8. The apparatus of claim 7, wherein ratio of length ($L_0$) of said mirror (32) to length (L) between midpoints of adjacent units (10A) in the moving direction is ($L_0$/L) about 0.3–0.7.

9. The apparatus of claim 8, wherein the ratio ($L_0$/L) is about 0.5.

10. The apparatus of claim 1, wherein said directing means constitute means for diverting a part ($F_3$) of the gas flow ($F_2$) from said nozzle apertures.

11. The apparatus of claim 10, additionally comprising a pair of walls (24*a*, 24*b*) in said unit (10) of which said radiation element (30) is mounted, and said diverting means comprise an aperture (22*a*, 22*b*) through each wall (24*a*, 24*b*), and through which the cooling gas flow ($F_3$) is directed to cool said radiation element (30).

12. The apparatus of claim 1, additionally comprising a mirror arrangement (32) positioned on an opposite side of the moving material (W) from said unit (10), and positioned to reflect ($S_2$) radiation which has passed ($S_1$) through the material (W), back to the material (W) to improve drying effect on the web (W).

13. The apparatus of claim 12, wherein said carrier surface (27) is positioned at a distance of about 5–40 mm from the moving material (W), and said mirror arrangement (32) is positioned at a distance of about 5–40 mm from the moving material (W).

14. The apparatus of claim 1, wherein each said holder (21*a*, 21*b*) is substantially L-shaped and comprises a groove (28*a*, 28*b*) in which said respective edge of said carrier surface (27) is mounted.

15. The apparatus of claim 1, wherein said angle (a) is between about 40° and 70°.

16. The apparatus of claim 1, wherein width of each said nozzle aperture (20*a*, 20*b*) is about 1–2 mm.

17. Apparatus for drying a moving, web-shaped material (W), comprising at least one radiation/gas blow unit (10) shaped in the form of a blow box and positionable to have a contact-free carrier surface (27) on a side thereof facing the moving material (W), means defining a nozzle aperture (20*a*) opening at an edge (21) of said carrier surface (27), positioned to direct a component of a gas jet ($Fu_1$) exiting therethrough substantially parallel to said carrier surface (27), and oriented to direct the gas jet ($Fu_1$) exiting therethrough at an angle (a) with respect to a plane substantially perpendicular to a plane substantially parallel to the material (W), a element (30) for generating radiation which is positioned in said unit (10), a window (27) positioned to form at least part of said carrier surface (27) and through which radiation ($S_0$) released by said element (30) passes and is directed at the moving material (W), means for directing a gas flow ($F_1$) through said unit (10) in a direction to cool said radiation element (30), wherein said correcting means constitute means (22*a*, 22*b*) for diverting a part (F3) of the gas flow (F2) away from said nozzle aperture (20*a*), a pair of walls (24*a*, 24*b*) in said unit (10) on which said radiation element (30) is mounted (29*a*, 29*b*), said diverting means comprising an aperture (22*a*, 22*b*) through each wall (24*a*, 24*b*) and through which the cooling gas flow ($F_3$) is directed to cool said radiation element (30), a pair of outer walls (12*a*, 12*b*), at least one (12*a*) of said outer walls (12*a*, 12*b*) having a chamfered end (16*a*) to constitute part of said means defining said nozzle aperture (20*a*, 20*b*), a pair of inner walls (13*a*, 13*b*) on which said radiation element (30) mounting walls (24*a*, 24*b*) are respectively mounted, and said respective inner (13*a*, 13*b*) and outer (12*a*, 12*b*) walls defining passageways (15*a*, 15*b*) for incoming gas flow (F1) into said unit (10).

18. The apparatus of claim 17, additionally comprising apertures (14*a*, 14*b*) in said respective inner walls (13*a*, 13*b*) for directing gas flow ($F_2$) therethrough and into said respective passageways (15*a*, 15*b*).

19. Apparatus for drying a moving, web-shaped material (W), comprising at least one radiation/gas blow unit (10) shaped in the form of a blow box and positionable to have a contact-free carrier surface (27) on a side thereof facing the moving material (W), means defining a nozzle aperture (20*a*) opening on an edge (21) of said carrier surface (27) and positioned to direct a component of a gas jet ($Fu_1$) exiting therethrough substantially parallel to said carrier surface (27), and oriented to direct the gas jet ($Fu_1$) exiting therethrough at an angle (a) with respect to a plane substantially perpendicular to a plane substantially parallel to the material (W), an element (30) for generating radiation which is positioned in said unit (10), a window (27) positioned to form at least part of said carrier surface (27) and through which radiation ($S_0$) released by said element (30) passes and is directed at the moving material (W), means for directing a gas flow ($F_1$) through said unit (10) in a direction to cool said radiation element (30), wherein said directing means constitute means (22*a*, 22*b*) for diverting a part (F3) of the gas flow (F2) away from said nozzle aperture (20*a*), a pair of walls (24*a*, 24*b*) in said unit (10) on which said radiation element (30) is mounted, said diverting means comprising an aperture (22*a*, 22*b*) through each wall (24*a*, 24*b*) and through which the cooling gas flow ($F_3$) is directed to cool said radiation element (30), a pair of holders (21*a*, 21*b*) on which said window (27) is mounted, each said holder (21*a*, 21*b*) being mounted on a respective wall (24*a*, 24*b*) on which said radiation element (30) is mounted, and said diverting means further comprising an aperture (F4) in each said holder (21*a*, 21*b*).

20. Apparatus for drying a moving, web-shaped material (W), comprising at least one radiation/gas blow unit (10) shaped in the form of a blow box and positionable to have a contact-free carrier surface (27) on a side thereof facing the moving material (W), means defining one and only one nozzle aperture (20*a*) opening on an edge (21) of said carrier surface (27), positioned to direct a component of a gas jet ($Fu_1$) exiting therethrough substantially parallel to said carrier surface (27), and oriented to direct the gas jet ($Fu_1$) exiting therethrough at an angle (a) with respect to a plane substantially perpendicular to a plane substantially parallel to the material (W) and generate a atmospheric pressure region (P−) between said carrier surface (27) and the moving material (W), an element (30) for generating radiation which is positioned in said unit (10), a window (27) positioned to form at least part of said carrier surface (27) and through which radiation ($S_0$) released by said element (30) passes and is directed at the moving material (W), means for directing a gas flow ($F_1$) through said unit (10) in a direction to cool said radiation element (30), and two holders (21*a*, 21*c*), in which said window (27) is mounted, one (21*a*) of said holders (21*a*, 21*c*) comprising a curved surface (21R) facing the moving material (W) and positioned with respect to said one and only one nozzle aperture (20*a*), to constitute a Coanda surface and deflect the gas jet ($Fu_1$) exiting from said nozzle aperture (20*a*) towards said subatmospheric pressure region (P−).

21. The apparatus of claim 20, wherein each said holder (21*a*, 21*c*) comprises a curved surface (21R) facing the moving material (W).

22. The apparatus of claim 20, wherein said angle (a) is between about 40° and 70° with respect to the plane substantially perpendicular to the plane substantially parallel to the material (W).

* * * * *